US009015998B2

(12) United States Patent
Turcot

(10) Patent No.: US 9,015,998 B2
(45) Date of Patent: Apr. 28, 2015

(54) AIRBEAM

(75) Inventor: Jean-Marc Daniel Turcot, Lake Country (CA)

(73) Assignee: Universal Airbeams Inc. (CA)

( * ) Notice: Subject to any disclaimer, the term of this patent is extended or adjusted under 35 U.S.C. 154(b) by 0 days.

(21) Appl. No.: 13/983,292

(22) PCT Filed: Feb. 2, 2011

(86) PCT No.: PCT/CA2011/000109

§ 371 (c)(1),
(2), (4) Date: Aug. 1, 2013

(87) PCT Pub. No.: WO2012/103620

PCT Pub. Date: Aug. 9, 2012

(65) Prior Publication Data

US 2013/0305619 A1 Nov. 21, 2013

(51) Int. Cl.

| | |
|---|---|
| ***E04C 3/02*** | (2006.01) |
| ***E04H 15/20*** | (2006.01) |
| ***E04C 3/00*** | (2006.01) |
| ***E04C 3/38*** | (2006.01) |

(52) U.S. Cl.

CPC ..... *E04H 15/20* (2013.01); *E04H 2015/201* (2013.01); *E04C 3/00* (2013.01); *E04C 3/38* (2013.01)

(58) Field of Classification Search

CPC ..... E04H 15/20; E04H 15/06; E04G 11/04; E04C 3/00; E04C 3/38; E04B 1/34

USPC ..... 52/2.11, 2.13, 2.17, 2.18, 2.22, 2.23, 52/2.24, 2.25, 2.26; 135/90, 96, 115, 135/124–127

See application file for complete search history.

(56) References Cited

U.S. PATENT DOCUMENTS

| | | | | |
|---|---|---|---|---|
| 584,115 | A | 6/1897 | Jeffery | |
| 2,051,643 | A * | 8/1936 | Morrison | 47/20.1 |
| 4,068,418 | A | 1/1978 | Masse | |
| 4,197,681 | A | 4/1980 | Holcombe | |
| 4,819,389 | A * | 4/1989 | Kihn | 52/2.21 |
| 5,005,322 | A * | 4/1991 | Mattick et al. | 52/25 |
| 5,397,258 | A | 3/1995 | Switlik et al. | |
| 5,421,128 | A * | 6/1995 | Sharpless et al. | 52/2.13 |
| 5,546,707 | A | 8/1996 | Caruso | |
| 5,735,083 | A * | 4/1998 | Brown et al. | 52/2.13 |
| 6,182,398 | B1 * | 2/2001 | Head | 52/2.13 |
| 6,260,306 | B1 * | 7/2001 | Swetish et al. | 52/2.18 |
| 6,263,617 | B1 | 7/2001 | Turcot et al. | |
| 6,463,699 | B1 * | 10/2002 | Bailey et al. | 52/2.11 |
| 8,166,711 | B2 * | 5/2012 | Lamke | 52/2.18 |
| 2005/0197212 | A1 | 9/2005 | Turcot | |

(Continued)

*Primary Examiner* — Beth Stephan
(74) *Attorney, Agent, or Firm* — Antony C. Edwards

(57) ABSTRACT

An airbeam includes at least a pair of inflatable beams each having an inner sleeve, middle sleeve and outer cover. Each sleeve is stitched to form flat side seams. The sleeves are inverted so that each flat side seam is disposed cantilevered inwardly on the inside of the sleeve. A linear common seam bisects the stitched side edges of the outer cover to form a pair of outer sleeves. One middle sleeve is nested within each outer sleeve. One inner sleeve is nested within each middle sleeve. One inner tube is nested in each inner sleeve. The nesting is arranged so that the side seams of the inner and middle sleeves are adjacent one another or overlap one another along, their entire length and so that the side seams of the outer cover are adjacent or overlap the side seams of the middle sleeve.

21 Claims, 12 Drawing Sheets

(56) References Cited

U.S. PATENT DOCUMENTS

| | | | | |
|---|---|---|---|---|
| 2007/0137113 | A1 | 6/2007 | Turcot | |
| 2008/0190472 | A1 | 8/2008 | Turcot | |
| 2008/0210282 | A1 | 9/2008 | Turcot | |
| 2008/0295417 | A1 | 12/2008 | Turcot | |
| 2008/0313970 | A1* | 12/2008 | Turcot | 52/2.18 |
| 2009/0249701 | A1 | 10/2009 | Turcot | |
| 2010/0175330 | A1 | 7/2010 | Turcot | |

* cited by examiner

AIRBEAM

FIELD OF THE INVENTION

This invention relates to the field of pneumatic tubes used to support in an upright position flexible shelters usually made of a flexible membrane such as fabric, and in particular to an air beam which includes a plurality of individual inflatable beams, each of which having a nested sleeve construction so as to constrain the expansion under high pneumatic pressure of an internal resilient inner tube.

BACKGROUND OF THE INVENTION

In the prior art, applicant is aware of applicant's own United States Patent Application, publication number US2008/0295417, published Dec. 4, 2008, for an Inflatable Beam Truss and Structure. In that patent application applicant describes a segmented inflatable beam truss which includes at least first, second, and third separate inflatable beams mounted to one another and having, respectively, first, second and third lengths and a substantially constant diameter amongst all of the three beams. Each beam includes an outer flexible substantially non-resilient sleeve along the entire length of the beam and an inner inflatable bladder extending substantially along and in the entire length of the sleeve. The applicant further teaches therein that, contrary to conventional wisdom which would require that pneumatic beams be increased in diameter as their length increases in order to support larger enclosures, that the use of a relatively narrow high aspect ratio pneumatic beam, where a plurality of such beams are mounted to one another, may be used to span relatively great distances if the beams are combined in side-by-side parallel array to form a single segmented beam truss. In jurisdictions allowing in corporation by reference, I hereby incorporate herein the aforesaid United States Patent Application Publication number US2008/0295417.

The drawback of that earlier design was that for use in high aspect ratio pneumatic beams I determined that the use of high pressurization was advantageous but caused the earlier design to fail. I have now found that using the airbeam of the present invention, for example as a twinned tube airbeam, or as an airbeam having a greater plurality of highly pressurized pneumatic tubes, that a greater stability may be achieved than I achieved in the past, where the airbeam resists twisting of the beam as it spans a long distance, for example forty-eight feet, and resists buckling at the vertex of the curvature when the airbeam is bent to provide a curved supporting member. Consequently, the earlier design had to be redesigned to allow for high pressurization for example pressurization exceeding 45-50 psi. As described below, the design of the present invention has been successfully tested at pressurization to 110 psi.

At high pressurization, I have found that the use of the earlier design, namely, the use of a single sleeve containing a resilient inflatable inner tube, failed along the stitching lines. Without the use of inverted sleeves and folded over, laterally spaced apart internal flat seams according to one aspect of the present invention, the expansion of the fabric at the seams allowed the resilient material, for example rubber, of the inflatable inner tube to push and expand into the spaces by bulging of the rubber between the stitching of the separating seams. I postulate that the bearing of the bulging rubber against the strands of the stitching increased the likelihood of failure along the seam.

The use of the highly pressurized airbeams according to the present invention was found to allow significant loading on the structure being supported by a plurality of such airbeams, when bent, so as to allowing forming for example of a dome or a quonset shape, when the ends of the bent airbeams are anchored to, for example, a floor panel or structure, and wherein the bending and the eventual domed or curved shape of the airbeam is governed by the curved shape of elongate fabric lumens formed in the flexible membrane of the domed structure.

Consequently, it is an object of the present invention, without intending to be limiting, to provide an airbeam capable of withstanding high pressurization and employing a plurality, for example, a pair of reinforced pneumatically inflatable beams mounted to one another so that the collective air beam is stabilized and resists twisting or buckling.

Other examples of pneumatically inflatable structures that I have designed may be found in for example, United States Patent Application Publication No. US2010/0175330 published Jul. 15, 2010, for an Inflatable Multi-Tube Structure, United States Patent Application Publication No. US2008/0210282, published Sep. 4, 2008, for an Inflatable Tent for Mounting into the Bed of a Pickup Truck, United States Patent Application Publication No. US2008/0313970, published Dec. 25, 2008, for an Inflatable Structure for Covering Sport Utility Vehicles, Boats and the Like, United States Patent Application Publication No. US2005/0197212, published Sep. 8, 2005, for an Inflatable Sport Ball Arresting Structure, United States Patent Application Publication No. US2007/0137113, published Jun. 21, 2007, for an Air Distribution System for Inflating Pneumatic Structures, United States Patent Application Publication No. US2008/0190472, published Aug. 14, 2008, for an Inflatable Structure for Covering Sport Utility Vehicles, Boats and the Like, United States Patent Application Publication No. US2009/0249701, published Oct. 8, 2009, for an Inflatable Quonset and Domed Structure and the Like, and U.S. Pat. No. 6,263,617, issued Jul. 24, 2001, for an Inflatable Self-Erecting Tent.

There is other prior art in the area of inflatable structures, for example, U.S. Pat. No. 6,260,306 which issued Jul. 17, 2001, to Swetish et al. for an Inflatable Shelter. Swetish et al. disclose an inflatable shelter having elongate inflatable tubes supported by the flexible membrane of the shelter so that a pair of the tubes form four legs supporting the membrane and wherein sleeves in the membrane define corresponding lumens for receiving the inflatable tubes. The lumens of the pair of sleeves are separated by at least one divider panel which extends substantially parallel to the pair of tubes.

SUMMARY OF THE INVENTION

In summary, one embodiment of the disclosed airbeam may be characterized in one aspect, as including a pair of resilient inner tubes, a pair of substantially non-resilient inner sleeves, a pair of substantially non-resilient middle sleeves, and a substantially non-resilient outer cover. When laid flat, each inner tube, each inner sleeve, each middle sleeve and the outer cover are substantially rectangular, each having a corresponding longitudinal dimension and a lateral dimension orthogonal to the longitudinal dimension. As used herein, the phrase substantially non-resilient means that the corresponding material or fabric expands slightly under tension, to an estimated five percent expansion when highly tensioned.

Each of the inner tubes' opposite ends are sealed, so that each inner tube is air-tight. The opposite ends of each inner tube are sealed by adhesive across the open ends and by being folded over along a fold-line adjacent the adhesive and the folded-over portion then bonded by further adhesive to an adjacent outer surface of the inner tube, adjacent the fold-line, so as to form a sealed folded-over end.

Each inner sleeve, each middle sleeve and the outer cover are each formed of an overlaid pair of substantially rectangular high aspect ratio sheets of flexible fabric sheeting. The overlaid pair of fabric sheeting has opposite ends and substantially linear side edges extending from, so as to extend between, the opposite ends. Each overlaid pair of fabric sheeting is stitched by side edge stitching along, and inset from each side edge, to form a flat side seam extending completely along each side edge and to form a corresponding cavity between the pair of side edge stitching. The cavity of the elongate sleeve so formed is bounded by the overlaid pair of fabric sheeting and the pair of side edge stitching. The stitching is also flexible. Once so formed, each overlaid and stitched pair of fabric sheeting is inverted, that is, turned inside-out, so that each flat side seam is disposed on the inside of the cavity of the sleeve and so that each flat side seam extends cantilevered inwardly into the cavity from the side edge stitching.

The outer cover further includes a substantially linear common seam, that is, linear when the sleeve is laid flat, which is parallel to the side edge stitching along each side edge. The linear common seam bisects the overlaid pair of fabric sheeting between the side edges. The linear common seam thereby forms a parallel, adjoining substantially identical pair of outer sleeves having the common seam therebetween. The pair of outer sleeves are thereby formed along the length of the outer cover.

One middle sleeve is nested within each outer sleeve of the pair of outer sleeves. One inner sleeve is nested within a corresponding middle sleeve in each outer sleeve. One inner tube is nested within a corresponding inner sleeve in each middle sleeve so as to form a parallel adjoining pair of inflatable beams adjoining along the common seam.

The longitudinal dimension of each inner sleeve, middle sleeve and the outer sleeve are substantially the same. The lateral dimension of the inner sleeve, middle sleeve and outer sleeve are, respectively, incrementally larger than one another so that the nesting of the inner, middle and outer sleeves is a snug nesting of one inside the other. Such snug, that is, tight, nesting causes each sandwiched flat side seam to be folded over against the adjacent sleeve walls. Thus the flat side seams of each side edge of the outer sleeve are folded over and compressed between each outer sleeve and a corresponding middle sleeve, and so that the flat side seams of each middle sleeve are folded over and are compressed between the corresponding middle sleeve and a corresponding inner sleeve. Each inner tube is journalled so as to be nested in a corresponding inner sleeve so that, when inflated, each inner tube compresses all of the flat side seams including the folded over side seams of each inner sleeve between each inner sleeve and the corresponding inner tube.

The nesting is arranged so that the side seams of the inner and middle sleeves are adjacent one another or overlap one another along their entire length and so that the side seams of the outer cover are adjacent or overlap the side seams of the middle sleeve. Whereby, upon inflation, the laterally outermost side seams of the inner sleeve, the middle sleeve and the outer cover are compressed substantially against one another so as to sandwich the side seam of the middle sleeve between the side seam of the inner sleeve and the side seam of the outer cover, thereby forming reinforced sidewalls on laterally opposite sides of the pair if inflatable beams when pressurized and inflated, the reinforced sidewalls herein alternatively referred to as reinforcing stringers.

Upon bending of the pair of inflatable beams when inflated to substantially 45 psi or more pressurization, the side seams lie substantially in three parallel planes which three parallel planes include the plane of curvature of the bending and of the airbeam. The two outermost planes of the three parallel planes include laterally outermost side seams of the pair of inflatable beams. The third plane is sandwiched between the two outermost planes and includes the common seam. When inflated to substantially 45 psi or more pressurization the side seams do not wrinkle but, rather, are compressed substantially flat, whereby buckling of the pair of inflatable beams at the vertex of the bend is inhibited during the bending of the airbeam. Although not intending to be limited to any particular theory of physical operation, applicant postulates that the combination of the three adjacent or overlapping side seams on each laterally outermost sidewall, when compressed at the high internal pressurization, act as stabilizing longitudinal stringers on each laterally opposite sidewall distributing the tension and compression forces due to bending along the side walls of the airbeam thereby inhibiting the stress relief mechanism of buckling formation. The stringers thus formed assist straightening the airbeam, inhibiting twisting or curvature of the airbeam out of the plane of bending. Further, the small (for example, five percent) expansion of each inflatable airbeam in the pair of airbeams, compress the airbeams against one another along the centrodial common seam, forming a further stabilizing wall along the common seam the tangent between the two tubes. This, it is postulated, further contributes to beam stability and resistance to buckling.

BRIEF DESCRIPTION OF THE DRAWINGS

In the drawings where like reference numerals denote corresponding parts in each view.

Figure 7A:
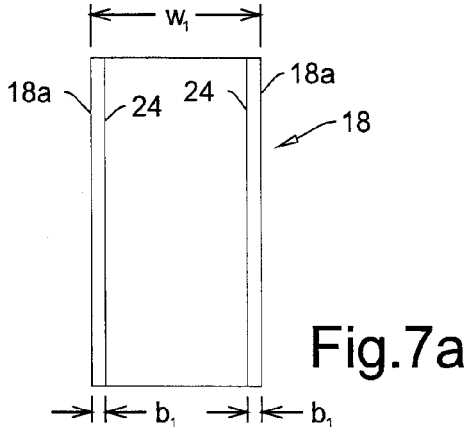

In the following descriptions of FIGS. 7*a*-7*b*, 8*a*-8*b*, 9*a*-9*b*, 10*a*-10*b* it is understood that what are represented are merely a cut-away, short segment of the inner sleeve, middle sleeve and outer cover respectively, it being intended that the sleeves and outer cover are of high aspect ratio so that the longitudinal length greatly exceeds the lateral width of each sleeve and the cover. The segments of the sleeves and cover are shown in their truncated form for ease of comparison between the views and for clarity, and wherein:

FIG. 7*a* is, in plan view when laid flat, a first pair of overlaid fabric sheets for forming the inner sleeve.

Figure 7B:
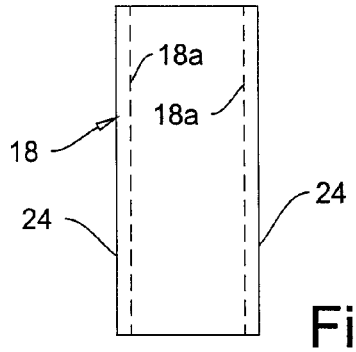

FIG. 7*b* is, in plan view when laid flat, the inner sleeve formed by inverting the overlaid pair fabric sheets of FIG. 7*a* once stitched along the side edges.

Figure 8A:
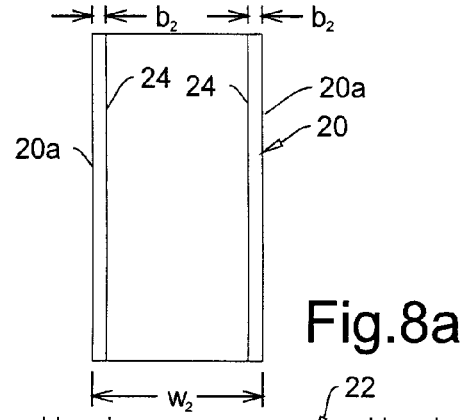

FIG. 8*a* is, in plan view when laid flat, a second pair of overlaid fabric sheets for forming the middle sleeve.

Figure 8B:
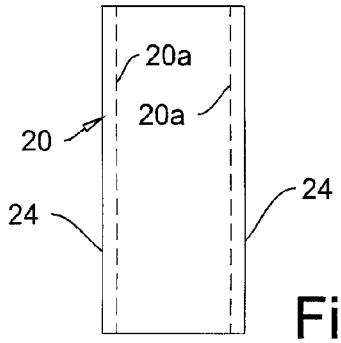

FIG. 8*b* is, in plan view when laid flat, the middle sleeve of FIG. 8*a* once stitched along the side edges and inverted.

Figure 9A:
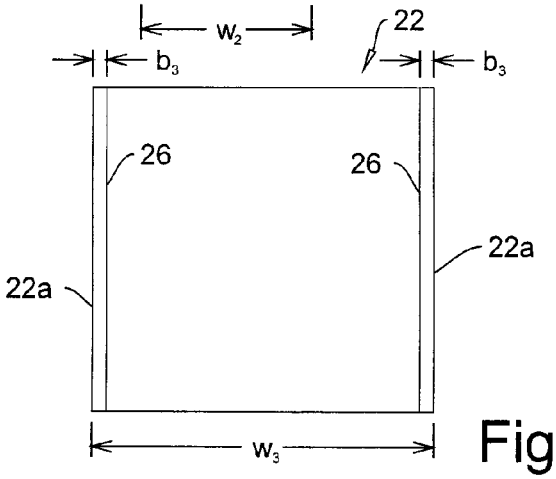

FIG. 9*a* is, in plan view, a third pair of fabric sheets when laid flat and overlaid on top of each other for forming the outer cover shown stitched along the side edges to form flat side seams.

Figure 9B:
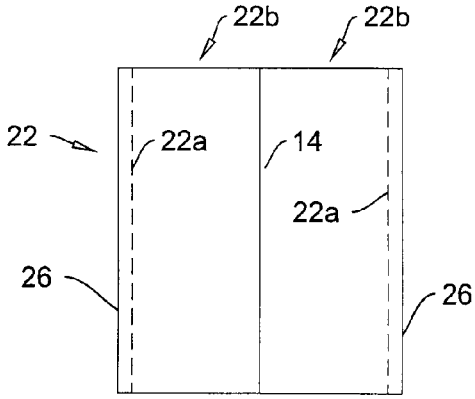

FIG. 9*b* is, in plan view when laid flat, the outer cover once the initially stitched third pair of fabric sheets have been inverted and a longitudinally centroidal common seam stitched therealong.

Figure 10A:
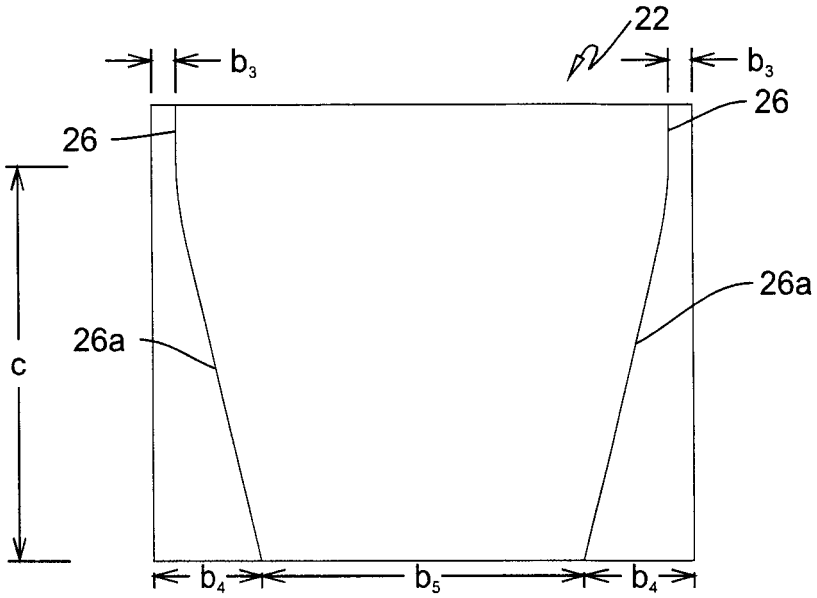

FIG. 10*a* illustrates in plan view when laid flat one of the ends of the outer sleeve of FIG. 9*a*, where the side edges are stitched so as to be gradually waisted laterally inwardly prior to the third pair of overlaid fabric sheets being inverted.

Figure 2:
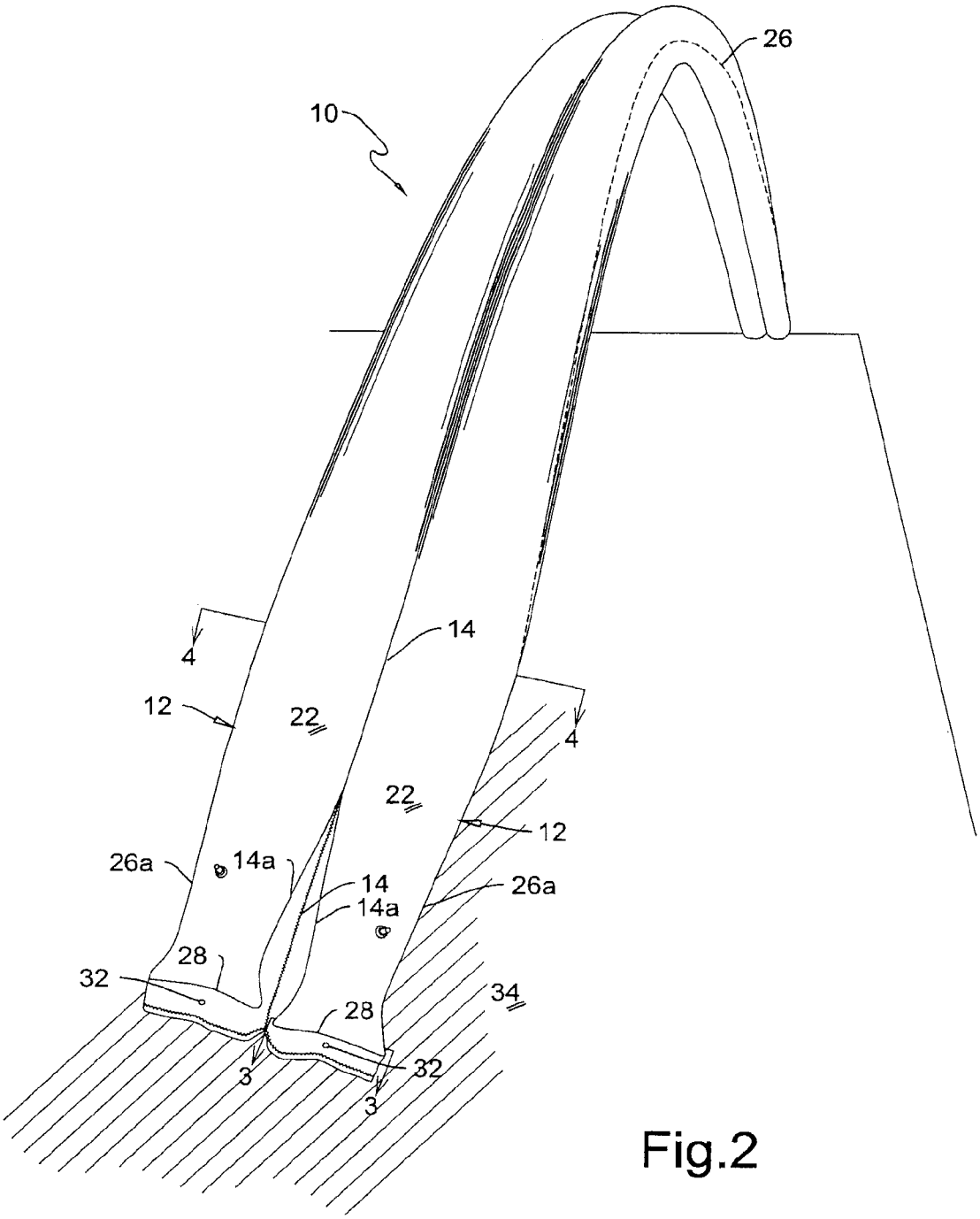
FIG. 2 is, in perspective view, of the twin-tube embodiment of the air beam of the present invention showing, at the near end, the waisting of the adjacent, separate ends of each inflatable beam in the adjoined twin-beam structure where the waisting tightly encapsulates the folded-over ends of the resilient inner tubes constrained within the multi-layer sleeve core construction of each inflatable beam within the twin-beam.
Figure 3:
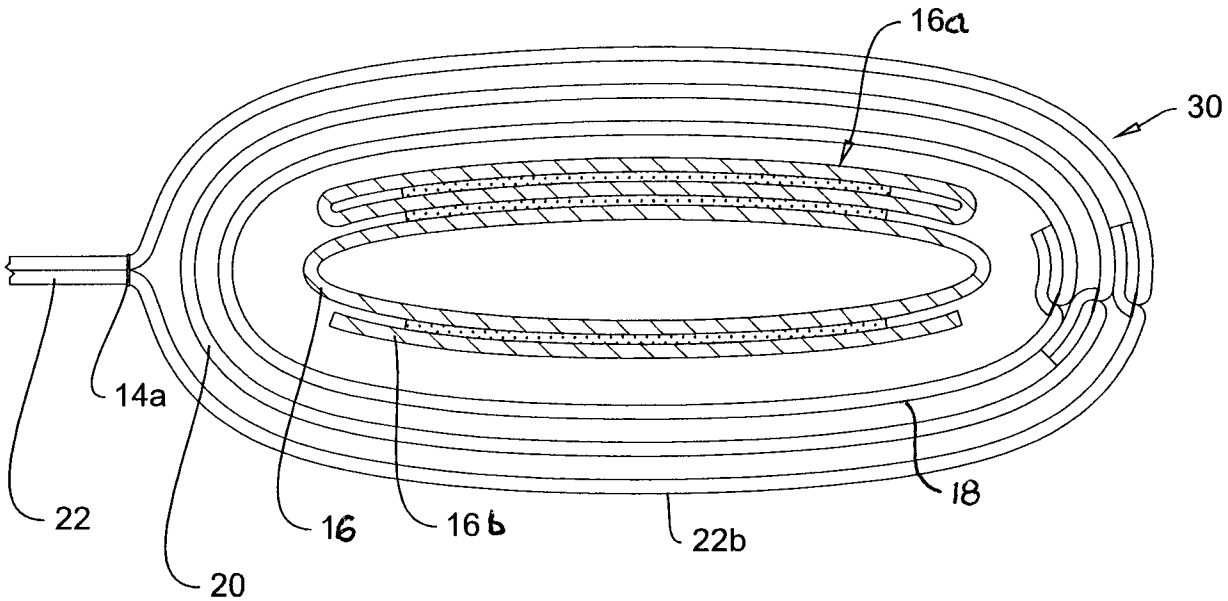
FIG. 3 is a cross section view along line 3-3 in FIG. 2.
Figure 10B:
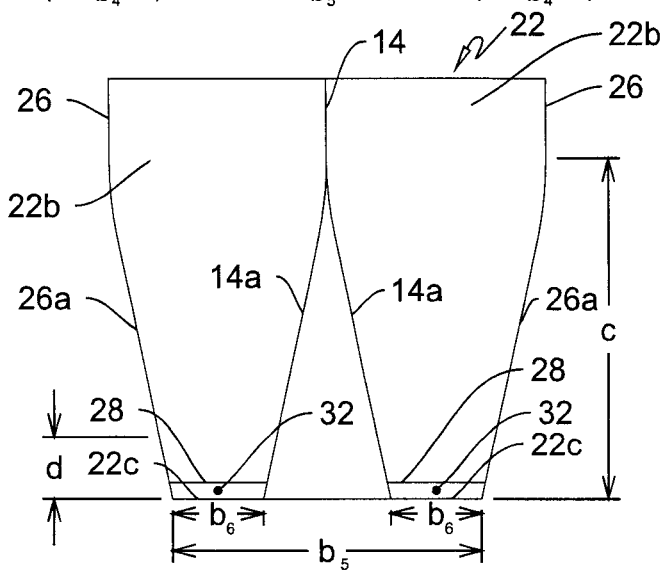

FIG. 10*b* is, in plan view when laid flat, the end of the outer sleeve of FIG. 10*a* once it has been inverted and then inner stitching done on the ends of the outer cover once the inner and middle sleeves have been inserted and the inner tube inserted so as to complete the substantially frusto-conical waisting which collars of each end of the inner tube supporting structures formed by the inner and middle sleeves and the outer cover, and so as to form in the waisted ends of the inflated beams seen in FIG. 2 once the inflatable beams are inflated to high pressurization.

Figure 11:
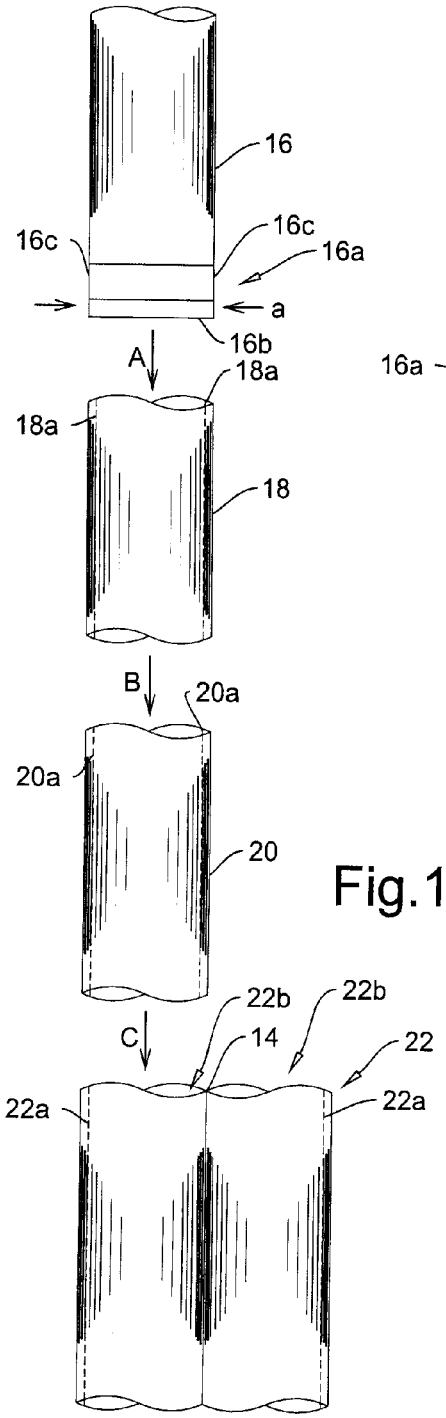

FIG. 11 is a partially cut-away, partially exploded front elevation view of truncated segments of the inner tube, inner sleeve, middle sleeve and outer cover of one embodiment of the present invention showing, starting at the top of the view, the insertion of an inner tube into an inner sleeve, and the insertion of the inner sleeve into a middle sleeve, and the insertion of the middle sleeve into a corresponding sleeve formed in the twin-beam outer cover so that the inner tube, inner sleeve, middle sleeve, are all nested within the outer cover, it being understood that a corresponding nested structure would occupy the other adjoining sleeve of the twin-beam outer cover.

Figure 12:
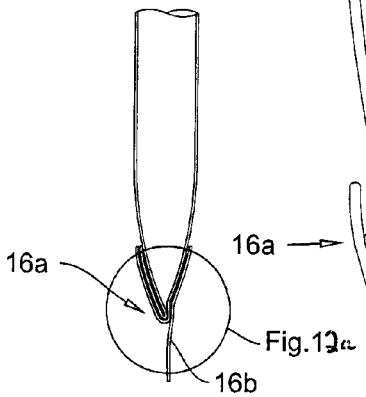

FIG. 12 is, in side elevation view, the inner tube of FIG. 11.

Figure 12A:
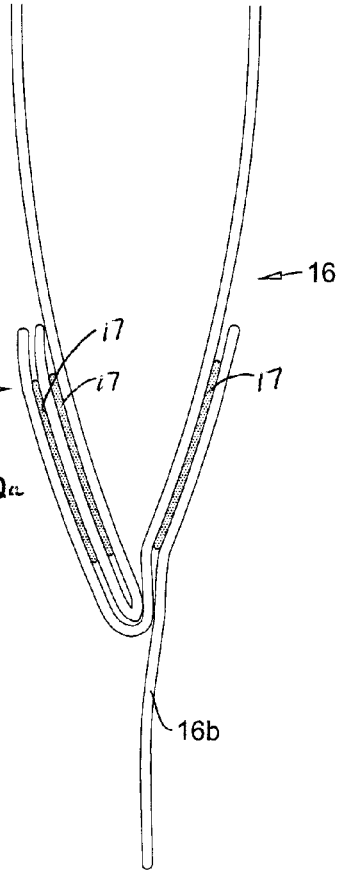

FIG. 12*a* is an enlarged view of the folded-over end of the inner tube of FIG. 12.

Figure 13:
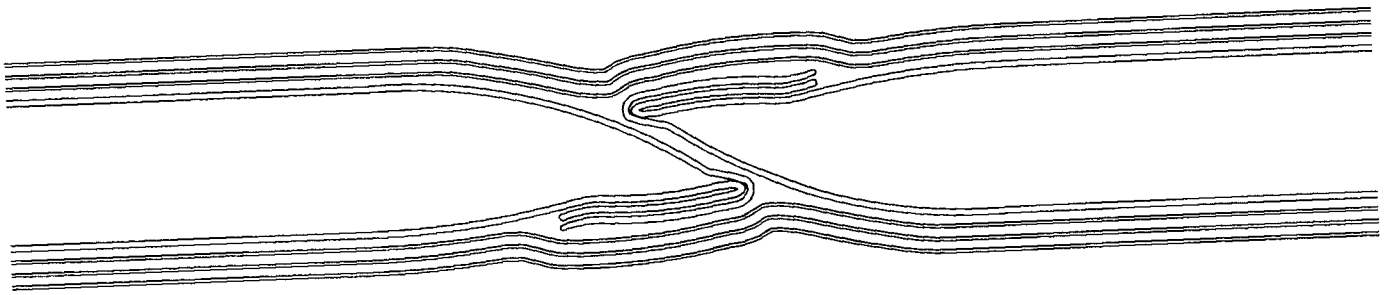

FIG. 13 is a cross-sectional view of a joining of two slightly over-lapping ends of end-to-end inner tubes within an inner sleeve, a middle sleeve, and an outer cover.

DETAILED DESCRIPTION OF EMBODIMENTS OF THE INVENTION

Pneumatic air beam 10 allows for pressurization to high air pressures in the order of 45-110 pounds per square inch (psi) while still allowing for bending of the airbeam. Airbeam 10 may thus provide a roof supporting beam in an inflatable structure having a plurality of such beams. It has been found that such high pressurization of the airbeams allows for tensioning of a fabric structure (not shown) supported by the airbeams sufficient to withstand for example a snow load or hundreds of pounds of weight suspended from the vertex of an airbeam supported structure supported by airbeams 10.

Figure 1:
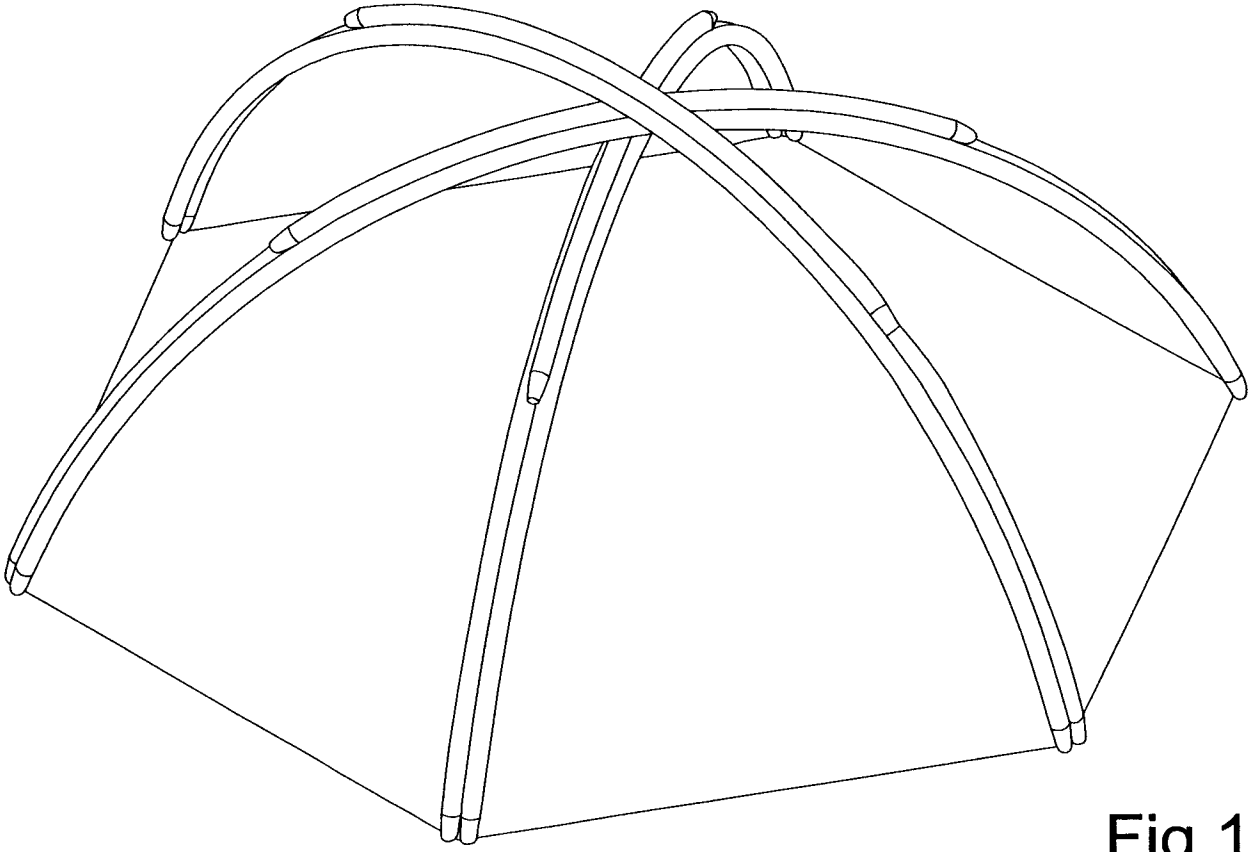
Fig.1 PRIOR ART
FIG. 1 is, in perspective view, a prior art inflatable structure.

It is been found through experimentation by applicant that according to the construction of airbeam 10 set out herein, bending of airbeams 10 when highly pressurized, such as seen in FIG. 2, has not resulted in buckling mid-way along the beam's length so as to change the curved shape of the domed airbeam of FIG. 2 into a triangle having a sharp vertex. Such a buckled beam would be inferior as it is desirable to maintain a domed shape to maximize the volume within a structure which is supported by inflated air beams and to avoid kinking or buckling of the seams or beams' themselves in order to avoid stress concentrations on the fabric of the beams sleeves or cover, or on the inner tube contained within the sleeves, again so as to avoid premature failure upon high pressurization. Problems which occurred in previous designs of pneumatic beams, such as seen in the prior art including that of FIG. 1, which were fabricated and tested by the applicant, and which problems have now been substantially overcome, included the twisting of the pneumatic beams or the cork-screwing of the pneumatic beams, upon their inflation in addition to seam failure at high pressurization and buckling.

In a preferred embodiment, each pneumatic beam 10 includes a parallel snugly adjacent pair of inflatable beams 12, each substantially identical to the other and joined along a common sewn seam line 14 so as to bear one inflatable beam against the other when highly pressurized. Each beam 12 includes a rubber inner tube 16 which is slid into, so as to be journalled in and along its complete length within an inner sleeve 18, which itself is journalled in and fully along the length of a middle sleeve 20, which itself is journalled in and along the full length of an outer sleeve of outer cover 22.

Inner tube 16 is formed as a continuous hollow rubber sleeve which has a lateral dimension, when the tube is deflated and laid flat, of 6.4 inches (140 millimeters) and indicated by dimension "a" (in FIG. 11) laterally across the end of folded end 16*a*. Folded end 16*a* is used to seal each end of inner tube 16. Each folded end 16*a* is secured in its folded position by the use of adhesive 17 known to those skilled in the art in the construction of rubber inner tubes. A rubber flange 16*b* is mounted, again by adhesive 17, to folded end 16*a* so as to leave a rubber flap extending away from folded end 16*a*. The flap of flange 16*b* is sandwiched between, and stitched to, the ends of sleeves 18 and 20 and within cover 22 to anchor folded ends 16*a*.

Inner and middle sleeves 18 and 20 are substantially identical when laid flat as seen in FIGS. 7*a* and 8*a* (diameters $w_1$ and $w_2$). Each sleeve 18 or 20 is made of two rectangular sheets of marine grade woven polyester, better described below, which are cut and laid flat with one sheet on top of the other. The widths $w_1$ and $w_2$ of sleeve 18 may be for example eleven inches (24.2 centimeters), and width $w_3$ may be twenty-two inches (48.4 centimeters). The overlaid pair of rectangular sheets, which may for example be thirty-five feet long, are sewn together by a parallel pair of stitch lines 24 which are inset from their corresponding free edges 20*a* by dimensions $b_1$ and $b_2$ for sleeves 18 and 20 respectively. Dimensions $b_1$, $b_2$ and $b_3$ are nominally ½ inch (1.1 centimeter). To assist in nesting of sleeve 18 into sleeve 20 and sleeve 20 into sleeve 22*b*, advantageously if dimension $b_3$ is actually ½ inch, then dimension $b_2$ would be ½ inch plus one millimeter, and dimension $b_1$ would be ½ inch plus two millimeters. Thus once sleeves 18 and 20, and outer cover 22 are inverted (i.e., in the steps between FIGS. 7*a* and 7*b*, between FIGS. 8*a* and 8*b*, and between FIGS. 9*a* and 9*b*), the resulting sleeve 18 is narrower than sleeve 20 and sleeve 20 narrower than sleeve 22*b*. The thread used to form edge seams 24 and common seam line 14 may be mono-cord bonded polyester thread, or other thread chosen, as would be known to one skilled in the art, to withstand 125 psi loading of the sleeve sheets. During the inflation of each beam 12 to high pressure the marine grade polyester fabric expands by approximately five percent (i.e., the width dimensions elongate by about five percent). The expansion of inner tube 16 tends to force each seam apart as better described below.

In the construction step from FIG. 7*a* to FIG. 7*b* inner sleeve 18, having been formed by two identical sheets of fabric, laid flat and edge stitched, is inverted so that the pair of parallel free edges 18*a* formed by edge stitch lines 24, are disposed inwardly into the interior of the inverted inner sleeve 18. In FIG. 7*b* edges 18*a* are shown in dotted outline within inverted sleeve 18.

Similarly, in the construction step from FIG. 8*a* to FIG. 8*b* middle sleeve 20 is inverted so that free edges 20*a* formed by edge stitch lines 24 are disposed inwardly into inverted middle sleeve 20. In FIG. 8*b* edges 20*a* are shown in dotted outline within inverted middle sleeve 20.

Lastly, in the construction step from FIG. 9*a* to FIG. 9*b* cover 22, which again is made of an overlaid pair of identical woven polyester sheets laid flat and sewn along edge stitch lines 26, is inverted so as to dispose free edges 22*a* inwardly into the inverted cover 22. In FIG. 9*b* edges 22*a* are shown in dotted outline. Once cover 22 is inverted common seam line 14 is formed by stitching in a line parallel to edge stitch lines 26 so that common seam 14 bisects therebetween. The same thread may be used for seam 14 as is used for edge stitch lines 24 and 26; for example mono-cord bonded polyester thread. That is, common seam line 14 is stitched down the middle of outer cover 22. Seam line 14 may stop shy of the ends of outer cover 22 by dimension c. Dimension c is the length of the tapering of the tapered end and may be eighteen inches (39.6 centimeters).

Keeping in mind that the length of airbeam 10 may be in the order of twenty-four feet to thirty-five feet long, although this is not intended to be limiting, it will be appreciated that edge stitch lines 26 and common seam line 14 extends substantially the entire length of pneumatic beam 10. The exception is that common seam line 14 may not extend to the opposite ends of the airbeam in the region where each inflatable beam 12 of the pair of beams 12 making up airbeam 10 (in the twin tube embodiment) is tapered. Inflatable beams having more than two parallel, side-by-side beams may also be constructed by enlarging the width dimensions of the sheets and increasing the number of common seams 14 (for example two parallel spaced apart seams 14 for a three tube embodiment, and increasing the number of inner tubes 16 accordingly).

The tapering is done to snugly support end 16*a* of inner tube 16 within a tight collar 30 formed by inner sleeve 18, middle sleeve 20, and outer cover 22. With the exception of FIG. 5, the Figures illustration of the various layers showing spacing between the layers is for ease of understanding of the views, it being understood that in reality when inner tube 16 is inflated, all of the layers forming collar 30 are tightly wrapped one to the other and all are tightly wrapped around folded end 16*a* of inner tube 16. When laid flat each tapered end of each beam 12 has a lateral dimension $b_6$ which closely matches the lateral dimension "a" of folded end 16*a* of tube 16. As stated above, dimension "a" may for example be 6.4 inches (14 centimeters) across, when measured pre-inflated and flat. The tapered stitch lines 26*a* smoothly and gradually curve from the ends of linear edge stitch lines 26 in a laterally inwardly tapered trajectory that results in a smooth tailoring of the sleeve diameters down to dimension $b_6$. Tapered seam lines 14*a* are oppositely disposed to each tapered edge stitch line 26*a*, and extend over the same longitudinal dimension "c" over which tapered stitch lines 26 extend. In one embodiment common seam line 14 smoothly bifurcates into a diverging pair of tapered seam lines 14*a* which taper substantially symmetrically to the taper of stitch lines 26*a* so that bifurcated common seam lines 14*a* complete the tapering of each end of each beam 12.

As seen in the construction step between FIGS. 10*a* and 10*b*, outer cover 22 is inverted so that free edges 22*a* are disposed inwardly, and common seam line 14 is stitched along outer cover 22. As seen in of FIG. 10*b* tapered seam lines 14*a* extend from the end of common seam 14. The length dimension tapered seam lines 14*a* is indicated by dimension "c". Tapering using tapered seam line 14*a* and tapered stitch lines 26*a* is used on both ends of each beam 12. As seen in FIG. 11, with inner tube 16 nested within inner sleeve 18 in direction A, and inner sleeve 18 nested within middle sleeve 20 in direction B, and with middle sleeve 20 nested in direction C into the corresponding outer sleeve 22*b* of outer cover 22, the folded end 16*a* of inner tube 16 is slid into position at the corresponding end 22*c* (seen in FIG. 10*b*) and in particular so that the distal edge of the rubber flap of flange 16*b* is flush with the end edge of ends 22*c*. Thus folded end 16*a* is entirely contained and constrained within collar 30 in a band "d" in end 22*c*. With inner tube 16 and the corresponding ends of sleeves 18 and 20 so positioned into end 22*c* in each of the pair of outer sleeves 22*b*, the sides of inner tubes 16 are snugged against seams 26*a*. Tapered seam lines 14*a* are then stitched along the length of dimension "c" to end 22*c*. Again, the stitching in each tapered seam line 14*a* is contoured laterally and smoothly to mirror and converge with the contour formed by stitch lines 26*a* so that within band d the stitching of both lines 14*a* and lines 26*a* are tightly adjacent to the corresponding edges 16*c* of folded end 16*a* for each of the inner tubes 16. It has been found that the stitching has to come in tight to edges 16*c* of the folded and bonded area of folded ends 16*a* so as to tightly support the folded ends 16*a*. Otherwise, at high pressurization of inner tube 16, at the opposite sides of where folded end 16*a* is bonded to tube 16, there is a risk of blow-out failure. Thus when each beam 12 is inflated, the fabric of each sleeve 18, 20 and that of ends 22*c* forming collar 30 are very tight bands around folded end 16*a* of inner tube 16 within band d. With folded end 16*a* and the corresponding ends of sleeves 18 and 20 positioned into ends 22*c* of outer cover 22, end seam 28 is stitched laterally across ends 22*c* so as to sandwich flange 16*b* between the layers of the ends of sleeves 18 and 20 and outer cover 22.

Apertures 32 may then be formed through those sandwiched ends and flange 16*b* so that the opposite ends of beams 12 may be fastened using conventional fasteners (not shown) for example to the ground or a ground sheet 34 of a structure (not shown) for which airbeam 10 is providing structural support. Thus with the opposite ends of airbeams 10 fastened securely down to the ground, or to the opposite edges of a ground sheet 34, and with airbeam 10 constrained within a further sleeve or lumen within the structure being supported, inflation of each of beam 12 in airbeam 10 to its operating pressure of for example fifty-five psi (being for example one half of its maximum pressure of 110 psi), beam 12 will smoothly curve to form a smooth arch from one end to the other, being constrained within the sleeve of the structure, without buckling or cork-screwing so as to provide load support for the roof of, and structural rigidity to, the structure.

In one embodiment strips of backing material may be added along the stitching lines 24 and 26 front and back of each pair of overlaid sheets and stitched together with the sheets to provide extra material to hold the stitching to very high pressurization.

Figure 4:
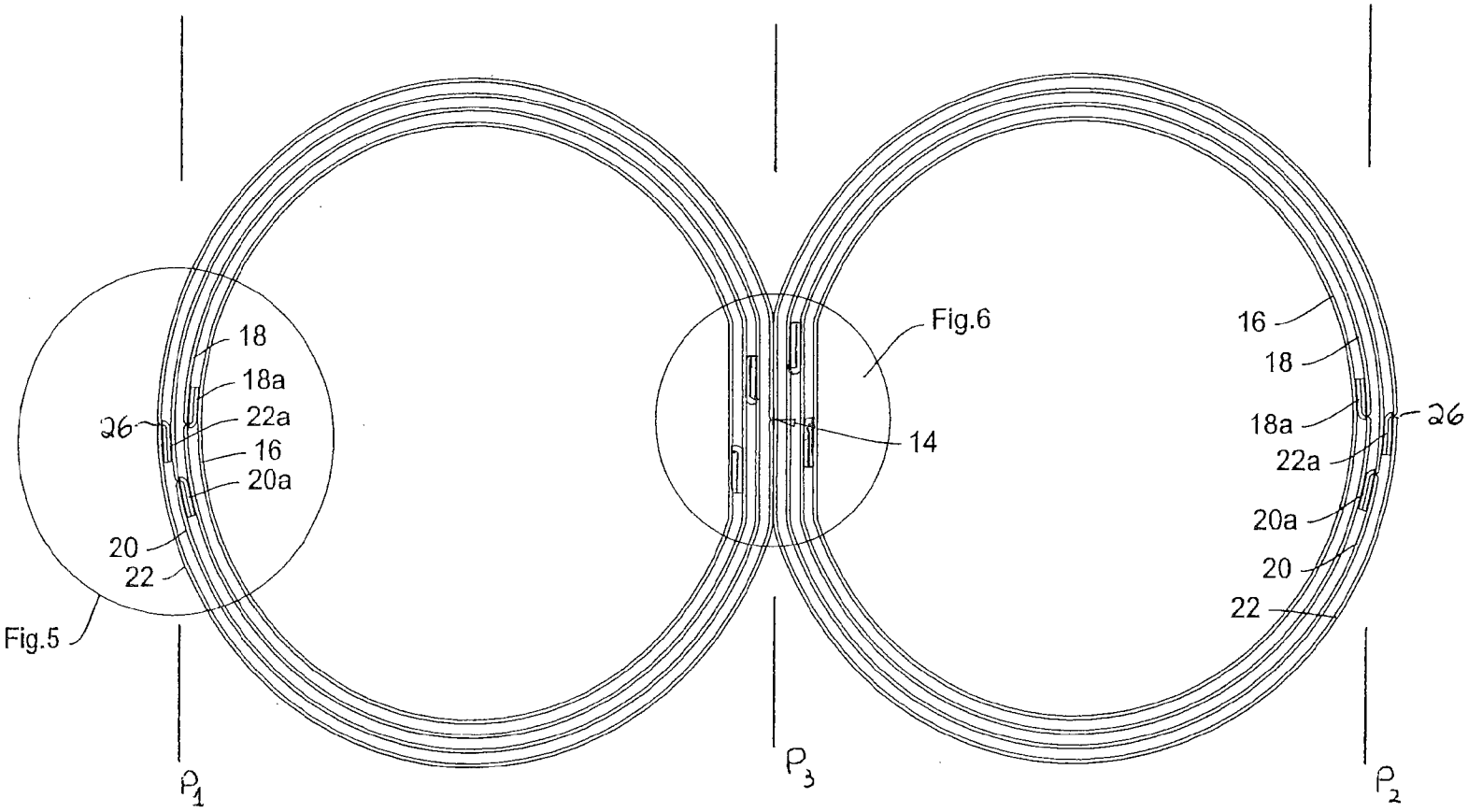
FIG. 4 is a sectional view along line 4-4 in FIG. 2.
Figure 5:
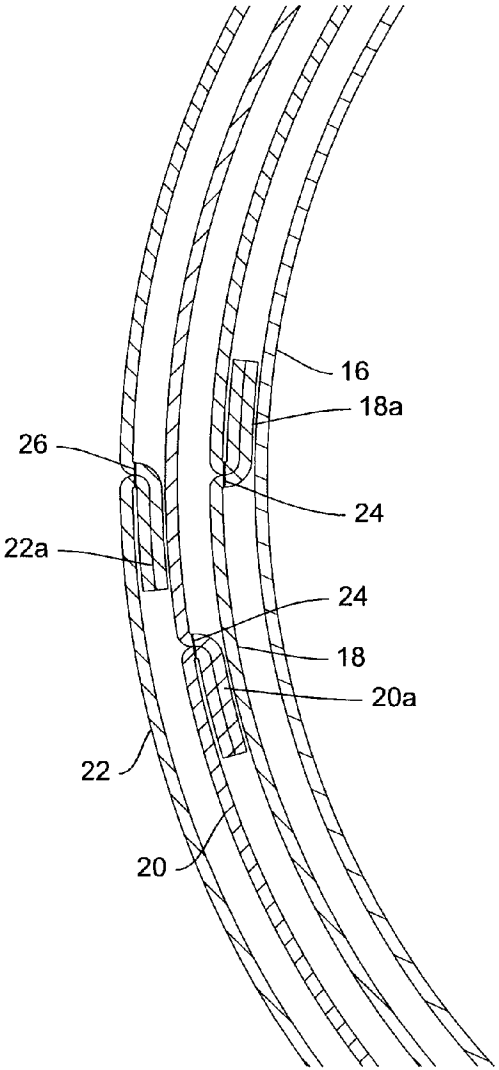
FIG. 5 is an enlarged view of a sidewall portion of FIG. 4, with the various layers shown slightly exploded from one another.
Figure 5A:
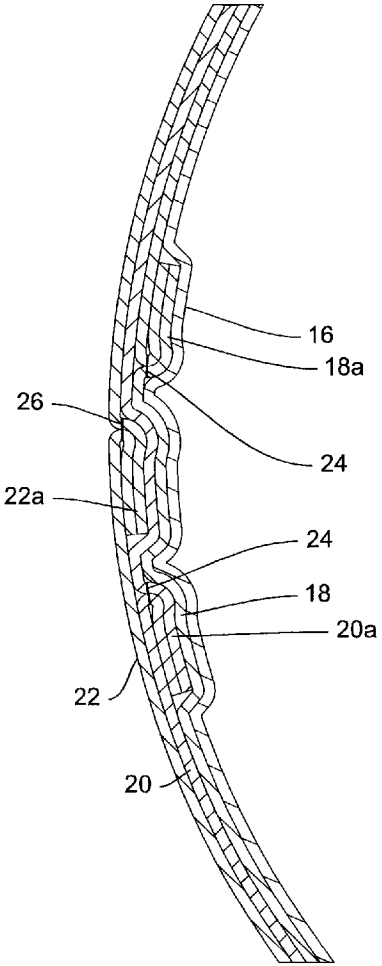
FIG. 5*a* is the view of FIG. 5 showing the layers of FIG. 5 when compressed against one another by a pressurized inner tube so as to form a sidewall reinforcing stringer along the length of the sidewall.
Figure 6:
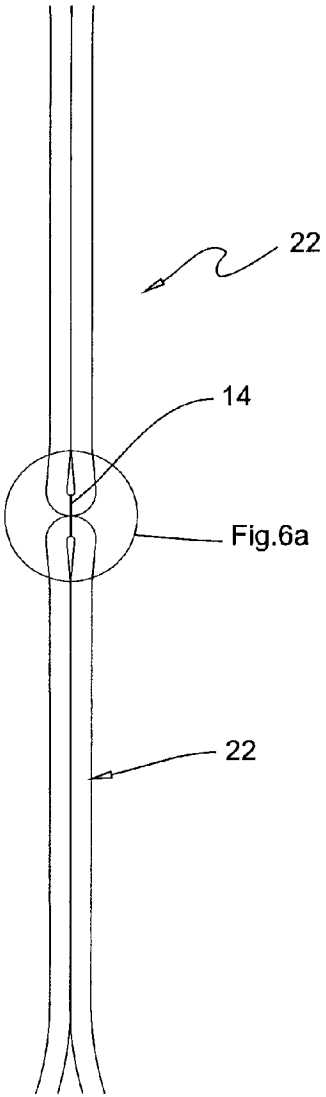
FIG. 6 is an enlarged view a second portion of FIG. 4.
Figure 6A:
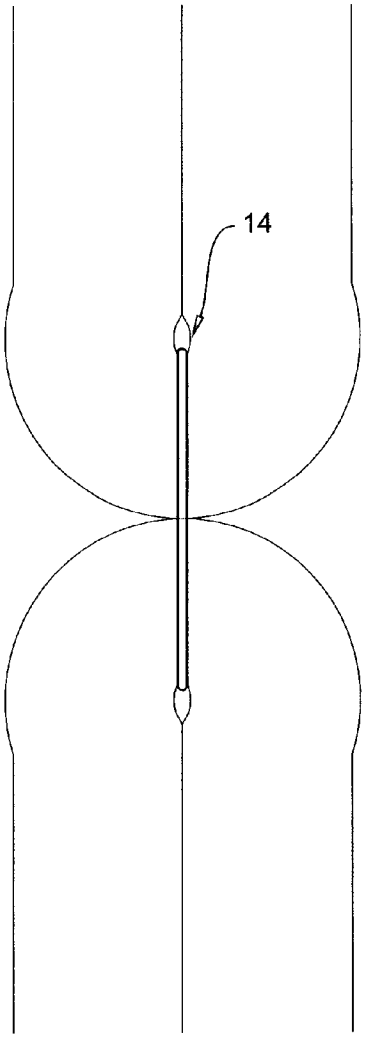
FIG. 6*a* is a further enlarged view of FIG. 6 showing the stitched seam which forms the common seam of FIG. 4.

The nesting is arranged so that, as seen in FIGS. 4, 5 and 5*a*, the side seams of the inner and middle sleeves are adjacent one another or more or less overlap one another along their entire length and so that the side seams of the outer cover are adjacent or more or less overlap the side seams of the middle sleeve. Thus, upon inflation of the inner tube, the laterally outermost side seams of the inner sleeve, the middle sleeve and the outer cover are compressed substantially against one another so as to sandwich the side seam of the middle sleeve between the side seam of the inner sleeve and the side seam of the outer cover, thereby forming reinforced sidewalls, which act as reinforcing stringers, on laterally opposite sides of the pair of inflatable beams when pressurized and inflated. The reinforced sidewalls thus lie substantially in three parallel equally spaced apart planes, namely the laterally outer sidewall planes $P_1$ and $P_2$, and the center plane $P_3$.

Upon bending of the pair of inflatable beams when inflated to substantially 45 psi or more pressurization, the side seams lie substantially in the three parallel planes $P_1$, $P_2$ and $P_3$, which include the plane of curvature of the bending and of the airbeam. The two outermost planes $P_1$ and $P_2$ include the tight sandwich of the laterally outermost side seams (inner and middle sleeve side seams and the outer sleeve side seams) of the pair of inflatable beams. The third plane $P_3$ is equidistant between the two laterally outermost planes $P_1$ and $P_2$ and includes the common seam 14. When inflated to substantially 45 psi or more pressurization the side seams, and hence the sidewalls, do not wrinkle but, rather, are compressed substantially flat hence forming a form of reinforced sidewall, whereby buckling of the pair of inflatable beams at the vertex of the bend is inhibited during the bending of the airbeam. Although not intending to be limited to any particular theory of physical operation, applicant postulates that the combination of the three adjacent or overlapping side seams of each reinforced sidewall when compressed at the high internal pressurization act as stabilizing longitudinal stringers on each laterally opposite sidewall, distributing the tension and compression forces due to bending along the side walls of the airbeam thereby inhibiting the stress relief mechanism of buckling formation. The longitudinal stringers thus formed by the reinforced sidewall assist in straightening the airbeam and inhibiting twisting or curvature of the airbeam out of the plane of bending. Further, the small (for example, five percent) expansion of each inflatable airbeam in the pair of airbeams, compress against one another along the centrodial common seam 14, forming a further stabilizing wall along the tangent on plane $P_3$ between the two tubes as shown in FIG. 4. This, it is postulated, further contributes to beam stability and resistance to buckling.

As seen in FIG. 13, when it is desired, airbeams may be fashioned by joining the ends of shorter inner tubes 16 end-to-end so as to form longer airbeams. Each inner tube in such an end-to-end coupling overlaps the other along the tapered portion of the tubes so that, once pressurized within continuous, nested inner, middle and outer sleeves, the coupling appears from the outside to be relatively smooth. It has been found that the coupling exhibits substantially the same strength in bending as other non-coupled portions of the airbeam.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An airbeam comprising:

a pair of resilient inner tubes, a pair of inner sleeves, a pair of middle sleeves, and an outer cover, wherein, when laid flat, each of said inner tubes, each sleeve, and said outer cover are substantially rectangular, each having a corresponding longitudinal dimension and a lateral dimension orthogonal to said longitudinal dimension, and wherein each of said inner tubes has opposite ends which are sealed, so that each of said inner tubes is air-tight, said opposite ends are sealed by being folded over along a fold-line and bonded to an adjacent outer surface of one of said pair of inner tubes that is adjacent to said fold-line, so as to form a folded-over end, and wherein each inner and middle sleeve and said outer cover are formed of an overlaid pair of substantially rectangular sheets of flexible fabric sheeting, wherein said overlaid pair of fabric sheeting has opposite ends and substantially linear side edges that extending between said opposite ends, wherein each of said overlaid pair of fabric sheeting is stitched by side edge stitching along and inset from each linear side edge to form a flat side seam that extends completely along each linear side edge to form a corresponding cavity therebetween that is flexibly bounded by said overlaid pair of fabric sheeting and said side edge stitching, and wherein each of said overlaid pair of fabric sheeting is inverted so that each of said flat side seams extends cantilevered inwardly into said cavity from said side edge stitching, and wherein said outer cover further includes a linear common seam that is parallel to said side edge stitching along each linear side edge and substantially bisecting said overlaid pair of fabric sheeting between said linear side edges, said linear common seam thereby forming a pair of parallel, adjoining substantially identical outer sleeves having said linear common seam therebetween, wherein a pair of outer sleeves are thereby formed along the length of said outer cover, and wherein one of said middle sleeves is nested within an outer sleeve of said pair of outer sleeves, and wherein one of said inner sleeves is nested within a corresponding middle sleeve of said pair of middle sleeves, and wherein one of said inner tubes is nested within a corresponding inner sleeve, of said pair of inner sleeves, so as to form a parallel adjoining pair of inflatable beams adjoining along said common seam, and wherein said longitudinal dimension of each of said inner sleeves, said middle sleeves and said outer sleeves are substantially the same, and wherein said lateral dimension of said inner sleeves, said middle sleeves and said outer sleeves are incrementally larger than one another respectively so that said nesting of said inner, middle and outer sleeves is tight nesting causing each corresponding flat side seam to be folded over so that said flat side seams of each of said side edges of said outer sleeves are folded over and compressed between each of said outer sleeve and the corresponding middle sleeve, and so that said flat side seams of each middle sleeve are folded over and compressed between said corresponding middle sleeve and the corresponding inner sleeve, and wherein each of said inner tubes is journalled so as to be nested in the corresponding inner sleeve so that, when inflated, each inner tube compresses said flat side seams of each of said inner sleeves between each inner sleeve and the corresponding inner tube, and wherein said nesting is arranged so that said flat side seams of said inner and middle sleeves and said flat side seams of said outer cover, upon inflation of said inner tubes, are compressed and form re-enforced sidewalls.

2. The airbeam of claim 1 wherein, upon bending into an arch of said pair of inflatable beams when inflated to at least substantially 45 psi or more pressurization, said flat side seams and said re-enforced sidewalls lie substantially in three parallel planes and which are all parallel to a plane of curvature of said bending, and wherein the two outermost planes of said three parallel planes include laterally outermost said flat side seams of said pair of inflatable beams, and wherein the third plane of said three parallel planes is spaced equidistant between said two outermost planes and includes said common seam, and wherein upon said pressurization said flat side seams are compressed substantially flat so as to lie substantially in a corresponding plane, whereby buckling of said pair of inflatable beams during said bending is inhibited.

3. The airbeam of claim 2 wherein said folded-over ends of each of said inner tubes have a lateral dimension which is less than said lateral dimensions of said inner and middle sleeves, and wherein, with said inner and middle sleeves nested in said outer cover, and said inner tube nested in said inner sleeve, opposite ends of said outer cover are tapered by tapering said side edge stitching laterally inwardly to thereby narrow the lateral dimension of said outer cover and form tapered opposite ends, wherein each of said tapered opposite ends tapers inwardly to form a constraining band, each constraining band entirely constrains one of said folded-over ends.

4. The airbeam of claim 3 wherein said inner tubes, inner sleeves, middle sleeves and outer cover are substantially 24 feet long, and wherein said tapering of said tapered opposite ends extends substantially one and a half feet therealong.

5. The airbeam of claim 3 wherein said tapered opposite ends are each substantially six and one half inches measured laterally across.

6. The airbeam of claim 3 wherein said constraining bands substantially covers said folded-over ends.

7. The airbeam of claim 6 wherein said constraining bands have a longitudinal dimension in the range of two to six inches.

8. The airbeam of claim 6 wherein said stitching along said constraining bands follows along each laterally opposite side of each constraining band.

9. The airbeam of claim 5 wherein said constraining bands substantially cover said folded-over end.

10. The airbeam of claim 9 wherein said constraining bands have a longitudinal dimension in the range of two to six inches.

11. The airbeam of claim 10 wherein said side edge stitching along said constraining bands follows along each laterally opposite side of each said band.

12. The airbeam of claim 7 wherein said lateral dimension of each of said inner sleeves and each of said middle sleeves are each substantially eleven inches before said sleeves are inverted.

13. The airbeam of claim 12 wherein said side seams are each laterally offset from corresponding said side edges by one half inch.

14. The airbeam of claim 6 wherein said common seam bifurcates to form two seams that are each a substantially mirrored image of said side edge stitching on oppositely disposed sides of said third plane.

15. The airbeam of claim 14 wherein said inner sleeves, said middle sleeves and said outer cover are all formed of identical fabric.

16. The airbeam of claim 15 wherein said fabric is woven polyester capable of withstanding 110 psi inflation pressure in said inner tubes.

17. The airbeam of claim 11 wherein said lateral dimension of each of said inner sleeves and each of said middle sleeves are each substantially eleven inches before said sleeves are inverted.

18. The airbeam of claim 17 wherein said side seams are each laterally offset from corresponding said side edges by one half inch.

19. The airbeam of claim 7 wherein said common seam bifurcates to form two seams that are each a substantially mirrored image of said side edge stitching on oppositely disposed sides of said third plane.

20. The airbeam of claim 19 wherein said inner sleeves, said middle sleeves and said outer cover are all formed of identical fabric.

21. The airbeam of claim 20 wherein said fabric is woven polyester capable of withstanding 110 psi inflation pressure in said inner tubes.

* * * * *